US007340846B1

(12) United States Patent
Jou

(10) Patent No.: US 7,340,846 B1
(45) Date of Patent: Mar. 11, 2008

(54) DRYING GUN

(76) Inventor: Wuu-Cheau Jou, No. 497-6, Tsao Hoo Rd., Tali, Taichung Hsien (TW)

( * ) Notice: Subject to any disclaimer, the term of this patent is extended or adjusted under 35 U.S.C. 154(b) by 0 days.

(21) Appl. No.: 11/690,406

(22) Filed: Mar. 23, 2007

(51) Int. Cl.
*F26B 21/00* (2006.01)

(52) U.S. Cl. ..... 34/523; 34/241; 239/433; 239/434

(58) Field of Classification Search ..... 34/523, 34/96–98, 201, 235, 241; 239/433, 434, 239/547
See application file for complete search history.

(56) References Cited

U.S. PATENT DOCUMENTS 3,801,020 A * 4/1974 Mocarski ..... 239/433
5,407,135 A * 4/1995 Jeffs ..... 239/434
6,702,203 B2 * 3/2004 Jou ..... 239/433

* cited by examiner

*Primary Examiner*—Jiping Lu
(74) *Attorney, Agent, or Firm*—WPAT, P.C.

(57) ABSTRACT

A drying gun includes a chamber and a handle made integrated with the body of the gun, an arc diverter being disposed between an inner end of a rear hole inside the chamber and an exhaust hole; a plug being placed in the rear hole in the chamber; a narrow exhaust gap being defined between a front surface of the plug and the inner end of the rear hole; a front tapered hole inside the plug being disposed corresponding to the arc diverter; the compressed air admitted through the exhaust gap being first guided by the arc diverter to follow the arc to change its direction into the exhaust hole thus to produce siphon effect; and the body of the drying gun may be combined with diffusers in different configurations.

6 Claims, 9 Drawing Sheets

DRYING GUN

BACKGROUND OF THE INVENTION (a) Field of the Invention

The present invention relates to a drying gun, and more particularly, to a body of the drying gun containing an arc diverter to reduce the noise level of a jet of compressed air while allowing adaptation of diverters in different configurations.

(b) Description of the Prior Art

A siphon type of drying gun of the prior art is essentially applied to dry spray coverage of water solvable painting. As illustrated in FIGS. 8 and 9 of the accompanying drawings, a jet of compressed air is directly introduced into a passage 91 of a drying gun through an aerated slot 81 at an angle of thirty degrees (30°) and a lower pressure is created at the jet outlet of the aerated slot 81 to produce siphon effects against the ambient air of a cover 95; and the ambient air outside the cover 95 enters into the passage 91 to mix with the compressed air before being delivered out of an air outlet 92 to dry the painted object by heat. However, the prior art is found with the following shortings:

1. It creates noise at extremely high level since the jet of compressed air directly flows into the passage 91 through the aerated slot 81, the impact of jet diffuse around the inner wall of the passage 91.
2. Whereas multiple resting ends 82 are disposed to an air inlet body 80, multiple gaps as were nozzles are formed between the resting ends 82 and a tapered hole 93 of the passage 91 in the head 90 of the gun. Accordingly, disturbance created in an air chamber 94 when the compressed air gushes into the air chamber 94 through the gaps results in instable jet to increase noise level (75 dB is measured at where 1.5 M away from the nozzle of the gun) and decrease the air amount delivered due to compromised siphon effects.
3. The compressed air consumes too much air per minute to warrant additional burden of the air compressor and increased consumption of energy since the compressed air is directly ejected into the passage 91 through the aerated slot 81.

SUMMARY OF THE INVENTION

The primary purpose of the present invention is to provide a drying gun to correct shortcomings of larger air consumption, inconsistent jet, and high noise level due to siphon effects produced by direct jet and multiple gaps functioning like nozzles found with the prior art.

To achieve the purpose, the present invention includes a body, a chamber in the body, and a handle made as an integrated part to the bottom of the body; the front end of the chamber contains a diffuse and a plug is placed in a rear hole at the opposite end, a narrow exhaust gap (approximately in width of 0.01~0.03 mm) is disposed between a front end surface of the plug and an inner end of the rear hole of the body; a rear cover is fastened into an inner screw hole disposed at the terminal of the rear hole; an arc diverter is disposed between the inner end of the rear hole and an exhaust hole; an air inlet connecting through the rear hole is disposed in the handle; front and front tapered holes in relation to each other are disposed penetrating through the plug; the front tapered hole is outwardly flared and is disposed at where in relation to the arc diverter; a strainer is disposed to the tail of the rear cover and is inserted in position by means of a cock; and an air valve is screwed to the bottom of the handle.

A starting point $S_1$ of the arc diverter in the present invention is at a level higher than a starting point $S_2$ of a camber of the taper angle of the front tapered hole. Accordingly, upon entering through an exhaust gap, the compressed air is first guided by the arc diverter disposed at a lower level to turn its direction into the exhaust hole by following the arc; and the jet of the compressed air accelerates for being subject to the shape of the narrow exhaust gap so to produce even smaller low pressure siphon effects at where the jet takes its turn for inviting more air to be sucked in and reduce the air consumption volume. Therefore, energy consumption is comparatively reduced while the smooth flow of the compressed air helps effectively lower the noise level of the jet.

The present invention by producing consistent jet at high flow rate and low pressure of the compressed air guided through the narrow exhaust gap and by the arc diverter to effectively improve siphon effects and air volume admitted, and reduce noise level during the operation and energy consumption while allowing the body of the gun to be adapted with a particular diffuser depending on the working angle or area.

DETAILED DESCRIPTION OF THE PREFERRED EMBODIMENTS

Figure 1:
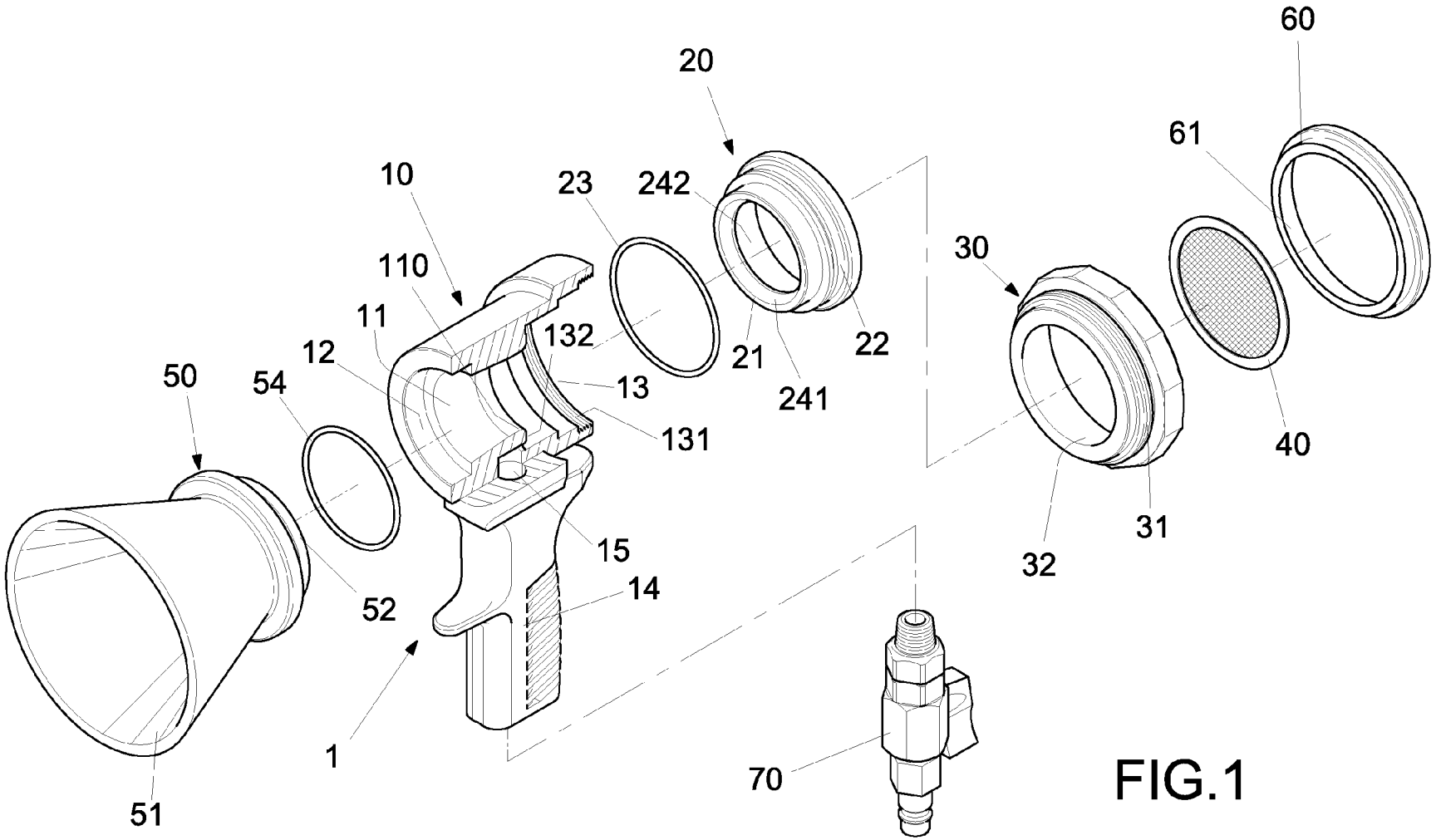
FIG. 1 is an exploded view of a preferred embodiment of the present invention.
Figure 2:
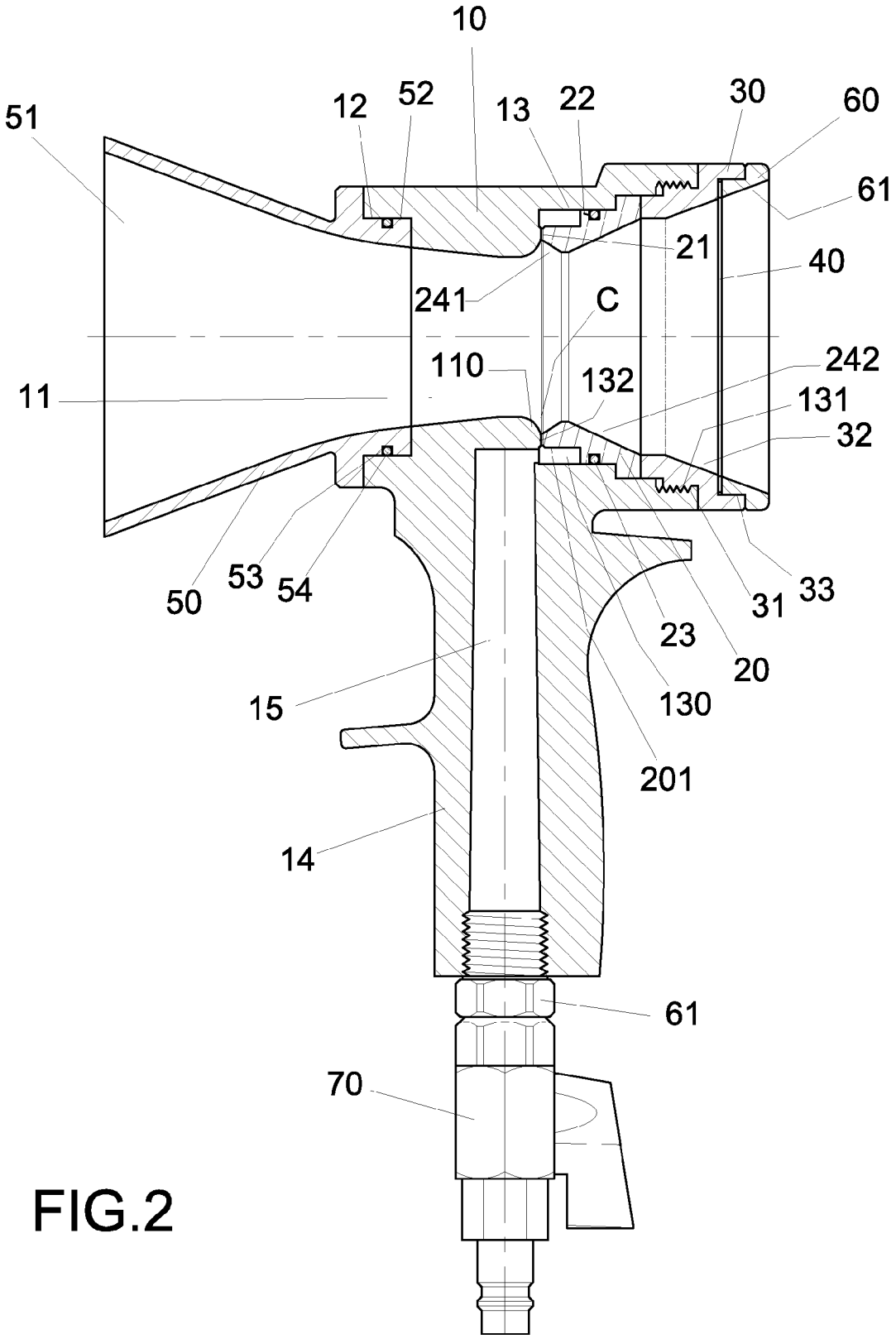
FIG. 2 is a sectional view of the preferred embodiment of the present invention as assembled.

Referring to FIGS. 1 and 2, the present invention comprises a body 1, a plug 20, a rear cover 30, a strainer 40, a diffuser 50, and a cock 60.

The body 1 contains a chamber 10 provided at its bottom an integral part of a handle 14; an exhaust hole 11 is defined inside the chamber 10, a front hole 12 is disposed in the front and a rear hole 13 is disposed in the tail to the exhaustion hole 11; an internal thread 131 is disposed to the terminal of the rear hole 13; an arc diverter 110 is disposed between an inner end 132 in the rear hole 13 and the exhaust hole 11; an air inlet 15 connecting through the rear hole 13 is disposed in the handle 14; and an air valve 70 is screwed to the bottom of the air inlet 15 of the handle 14.

The plug 20 contained in the rear hole 13 of the chamber 10 has a front surface 21; an annual groove 22 is disposed to the plug 20 to receive insertion of an O-ring 23; a front tapered hole 241 and a rear tapered hole 242 corresponding to and connecting through each other are provided in the plug 20; the front tapered hole 241 is outwardly flared with a shorter range of travel and is made corresponding to the arc diverter 110; and the rear tapered hole 242 has a longer range of travel.

The rear cover 30 is provided with a threaded portion 31 to screw into the rear section of the chamber 10 and hold against the plug 20, an air inlet tapered hole 32 connects through the rear cover 30; and an accommodation hole 33 is provided at the rear end of the rear cover 30.

The strainer 40 is inserted into the accommodation hole 33 of the rear cover 30.

The diffuser 50 contains an outwardly flared hole 51; a collar 52 at one end of the diffuser 50 is disposed with an annual groove 53 to receive insertion of an O-ring 54; and the collar 52 is tightly sealed into the accommodation hole 12 at the front of the chamber 10 due to elasticity provided by the O-ring 54.

The cock 60 is inserted into the accommodation hole 33 of the rear cover 30 to secure the strainer 40; and the cock 60 contains an inner tapered hole 61.

Figure 3:
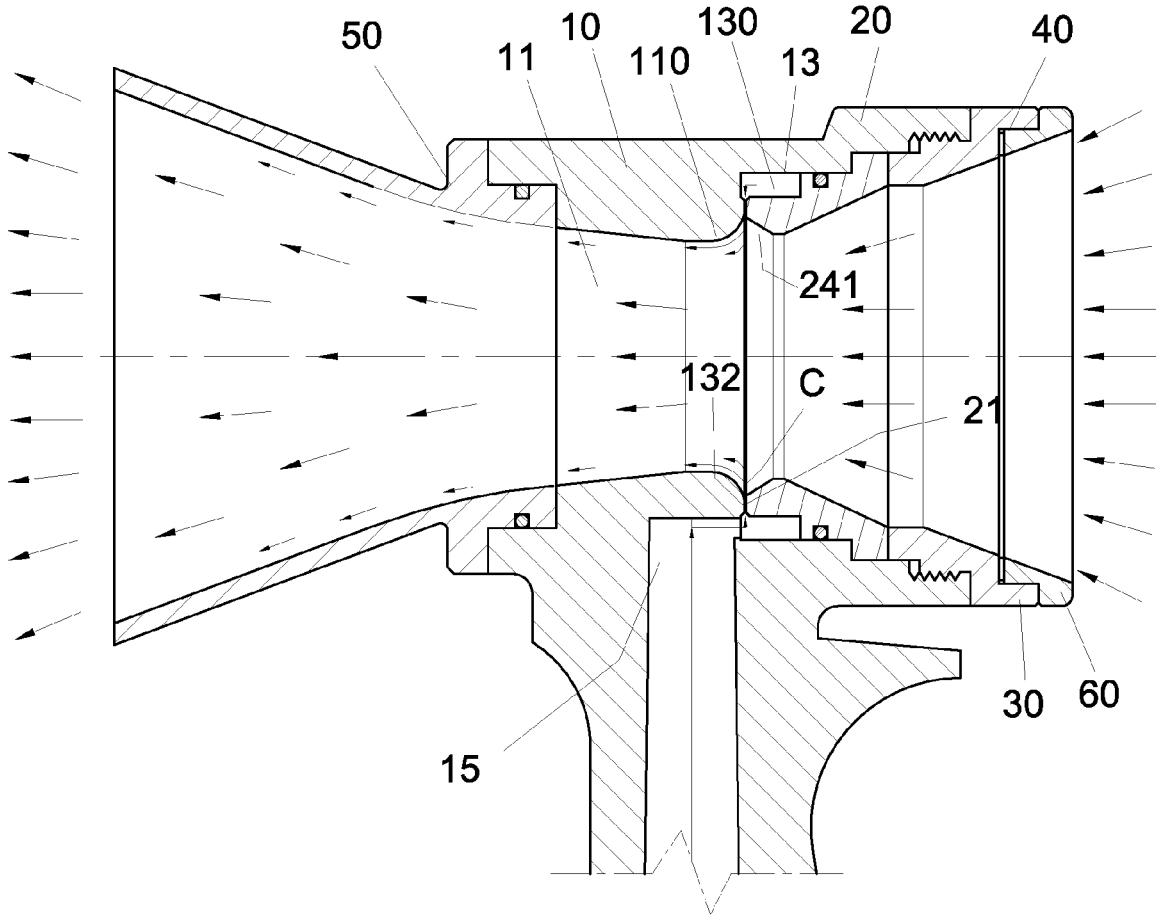
FIG. 3 is a schematic view showing flowing pattern of the compressed air and the ambient air sucked in due to siphon effects.

Now referring to FIGS. 2 and 3, the rear cover 30 is screwed to the tail of the chamber 10 to define an air chamber 130 between a collar 201 of the plug 20 and the rear hole 13 of the chamber 10. The compressed air imported through the air inlet 15 fills up the air chamber 130. A narrow exhaust gap C (approximately in width of 0.01~0.03 mm) maintained between the front surface 21 of the plug 20 and the inner end 132 of the rear hole 13 admits the compressed air to flow into the chamber 10.

As illustrated in FIG. 3, the compressed air introduced through the air inlet 15 into the air chamber 13 circulates by following the shape of the air chamber 130 to fill up the air chamber 13 before being guided through the exhaust gap C into the chamber 10. According to the enlarged view, it appears that a height $H_1$ of a starting point $S_1$ of the arc diverter 110 is at a level lower than a height $H_2$ of a starting point $S_2$ of a camber of the front tapered hole 241 with both heights H1 and H2 measured from a starting point of the exhaust gap C and the difference of the height between $H_1$ and $H_2$ is very small. Accordingly, upon entering through the exhaust gap C, the compressed air will be first guided by the arc diverter 110 at a lower level to follow the arc diverter 110 and take a turn into the exhaust hole 11; meanwhile, the compressed air will not flow backwards since there is no substantial object to guide the airflow in the camber of the front tapered hole 241 so that the compressed air exactly ejects in the direction by following the arc diverter 110.

Figure 4:
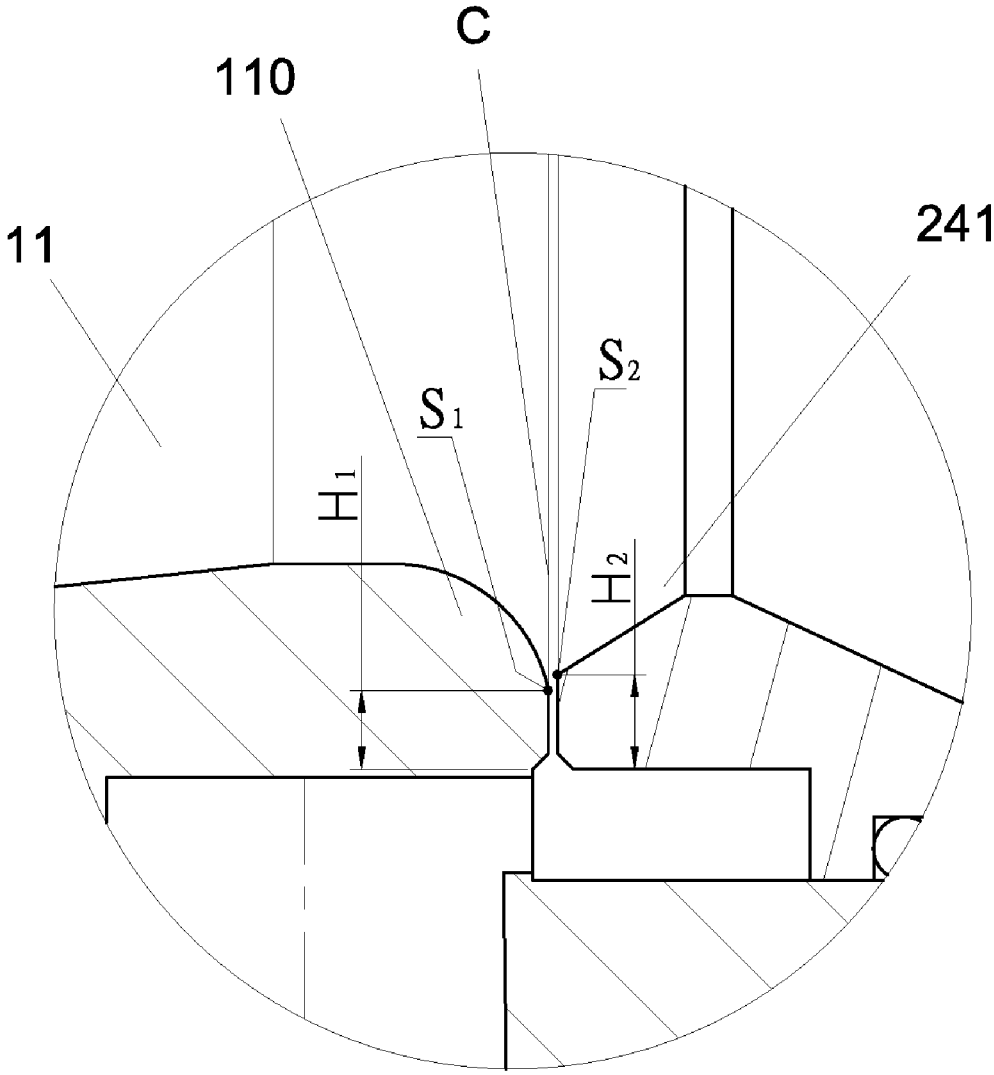
FIG. 4 is an enlarged view showing a local part of an exhaust gap created by mounting a rear cover to the gun.
Figure 5:
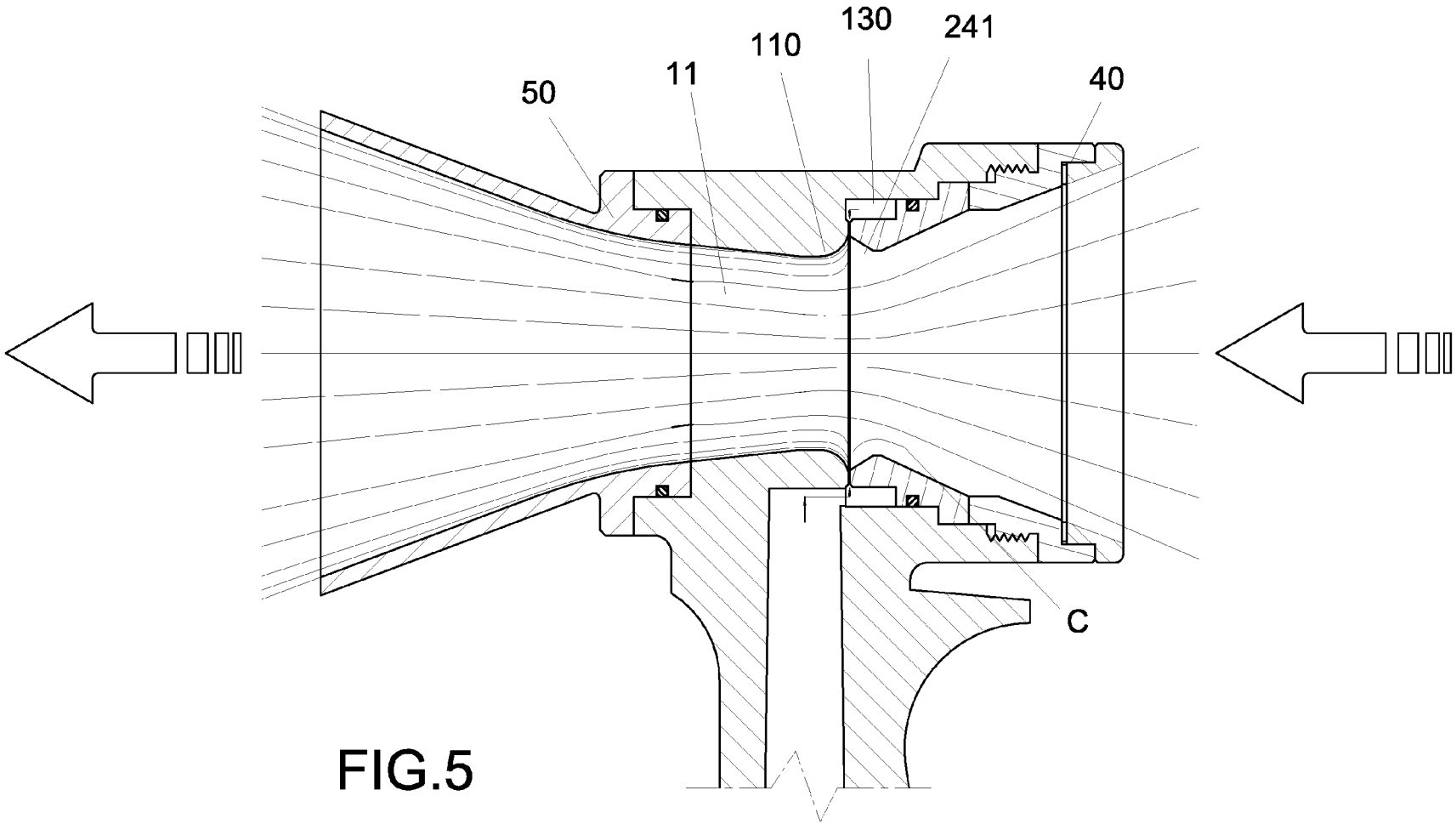
FIG. 5 is a schematic view showing a consistent airflow in a working status of the preferred embodiment of the present invention

As illustrated in FIGS. 3, 4, and 5, the reduced area of the exhaust gap C, the flow rate of the compressor air accelerates according to the freewheeling principal, and the jet of the compressed air indicates a donut shape that flows as guided by the arc diverter 110 in the direction heading for the exhaust hole 11 and flows against the edges of the exhaust hole 11. With the accelerated flow rate at the arc diverter 110, the compressed air creates an even lower low pressure at the outlet of the jet according to Bernoulli's principal. The low pressure formed at the front tapered hole 241 produces siphon effects against the ambient air outside the rear cover 30. The ambient air at zero pressure (according to the pressure gage) enters into the rear cover 30 to be mixed with the compressed air in the exhaust hole 11; and the mixed air ejects from the outer end of the diffuser 50.

Figure 6:
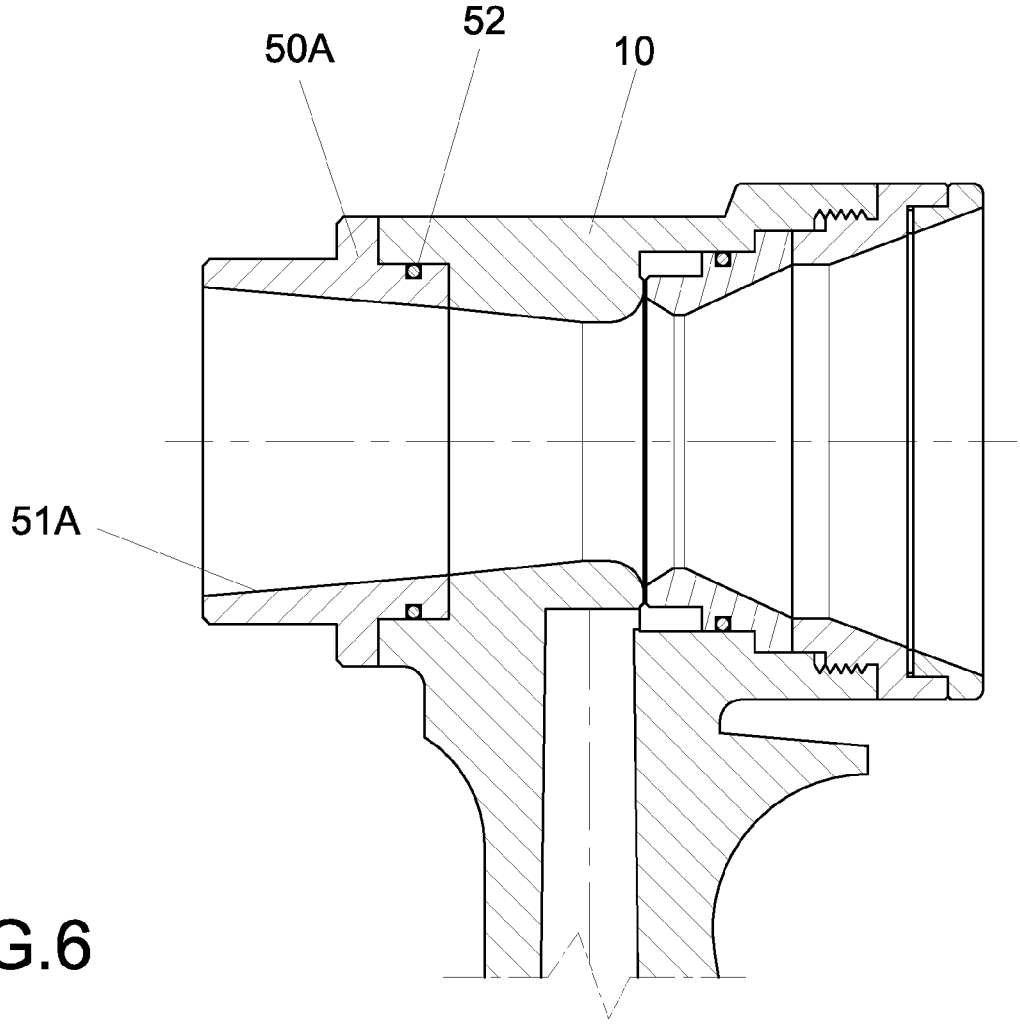
FIG. 6 is a sectional view showing the preferred embodiment of the present invention adapted with another type of diffuser.
Figure 7:
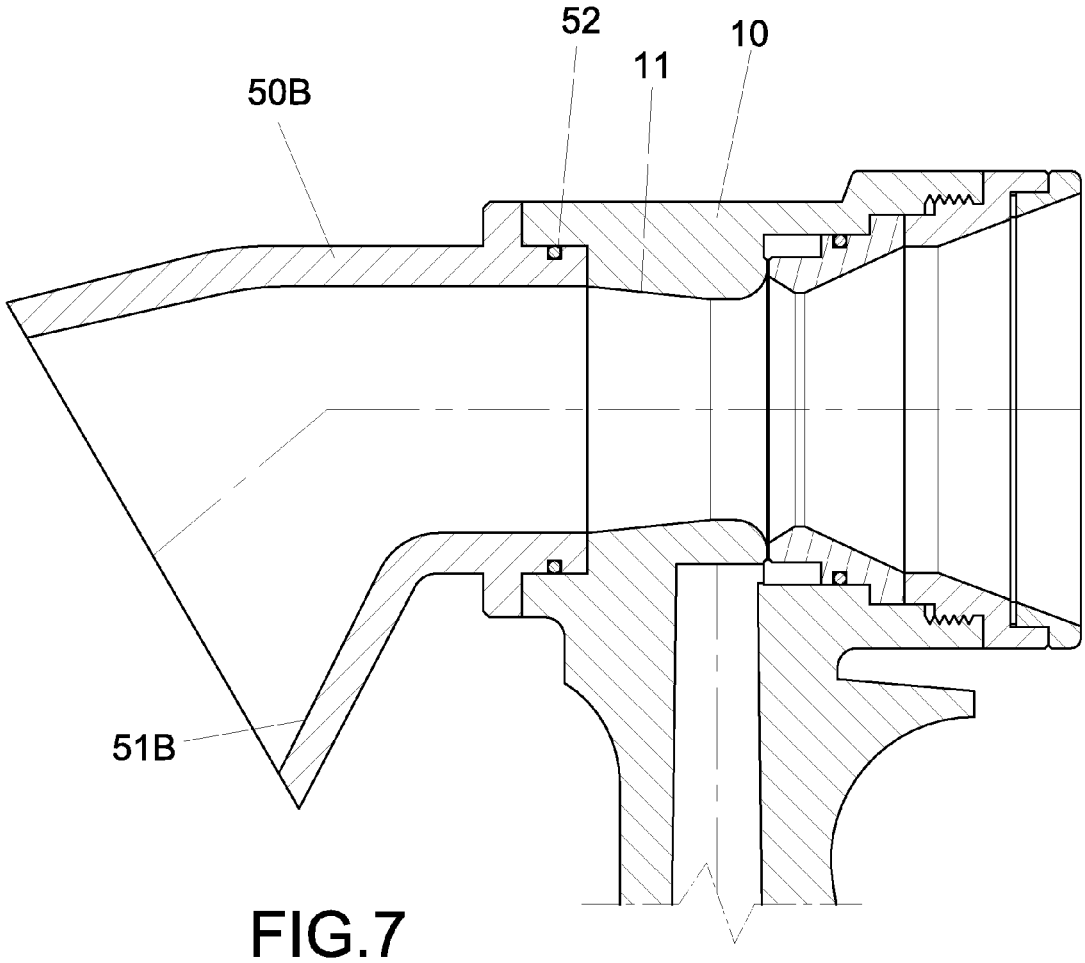
FIG. 7 is a sectional view showing the preferred embodiment of the present invention adapted with another type of diffuser.
Figure 8:
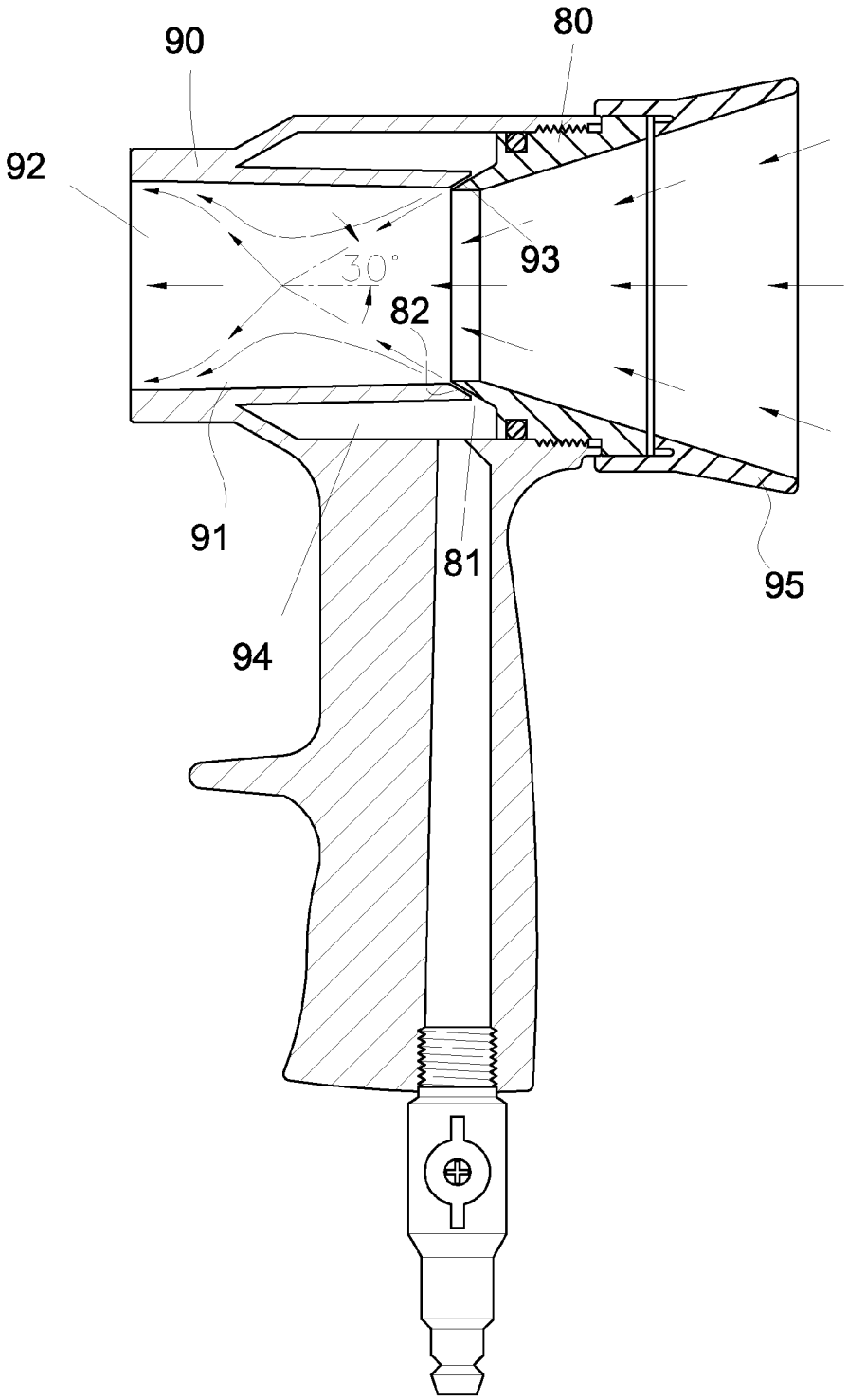
FIG.8 (PRIOR ART)
FIG. 8 is a sectional view of a drying gun of the prior art.
Figure 9:
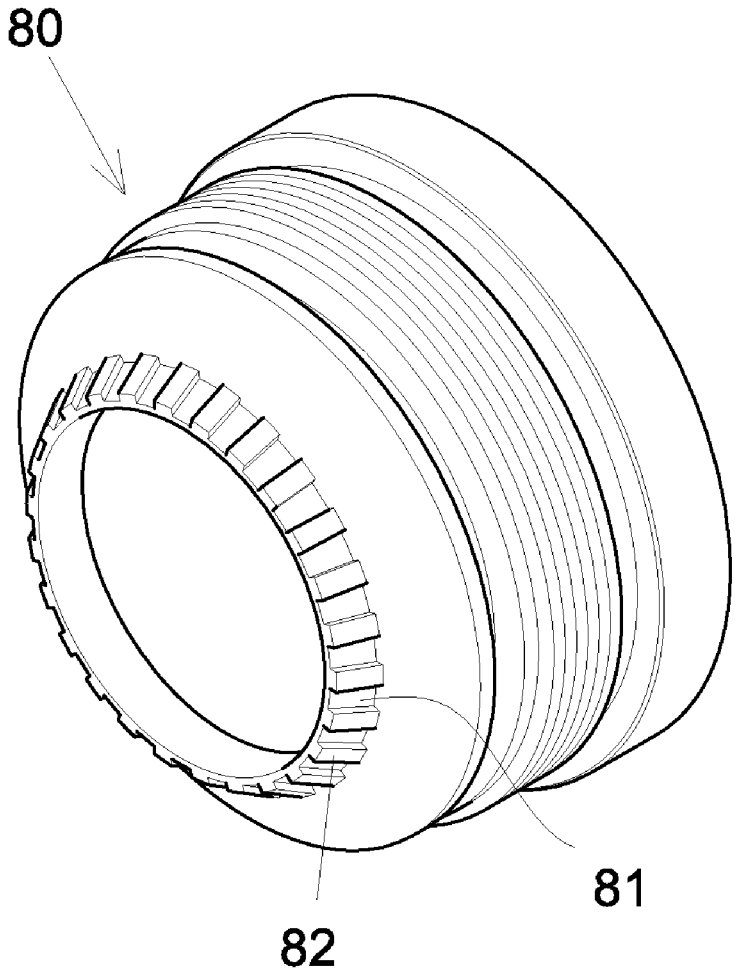
FIG.9 (PRIOR ART)
FIG. 9 is a perspective view of an air inlet construction of the drying gun of the prior art.

Both diffusers 50A and SOB as respectively illustrated in FIGS. 6 and 7 may be of different types and made detachable. The sectional area of a flared hole 51A of the diffuser 50A is smaller than that of the flared hole 51 of the preferred embodiment illustrated in FIGS. 1~5. A flared hole 51B of the diffuser SOB, as illustrated in FIG. 7, is in a direction that defines a certain angle with the direction of the exhaust hole 11 of the chamber 10 to be readily for replacement. The O-ring 54 inserted onto the diffuser 50A, SOB is made of rubber to provide great resistance by friction to firmly secure the diffuser 50A, 50B to the chamber 10 when installed therein. Accordingly, there is no risk of having the diffuser 50A and SOB to fall out of position while the drying gun operates. Depending on the work requirements, the diffuser SOB of a different blowing angle, or the differ 50A of a different blowing coverage may be elected to facilitate the drying operation.

As illustrated in FIGS. 1 and 2, the strainer 40 is placed behind the rear cover 30, that is, behind the body 1 of the gun, to allow easy removal for cleaning. The rear cover 30 must be periodically cleaned to remove dusts so to prevent from blocking the flow of air. To clean the strainer 40, simply pull out the cock 60 to replace or clean as applicable.

The cock 60 is made of flexible rubber, silicon gel, plastic, or similar material to allow it to be easily mounted to or removed from the rear cover 30, and firmly secured once mounted to the rear cover 30.

Whereas the compressed air flows by following the shape of the arc diverter 110 and takes a turn in the direction of the exhaust hole 11, it provides a very consistent jet (as illustrated in FIG. 5) with a noise level of 68 dB (measured at 1.5 M away from the jet outlet) achieving a reduction of 7 dB from that of the prior art. Whereas the present invention provides a stronger siphon than the prior art, the ratio between the jet of the compressed air and the ambient air externally to the siphon is 1:4 with a specific value higher than 1:3 of the prior art. Increased air suction volume in turn reduces air consumption, On-Off operation frequency of an air compressor, and power consumption to effectively reduces noise level, improve siphon effects, and increases air inlet volume to reduce air consumption of the compressed air, and power on/off frequency of the air compressor, and thus comparatively the reduction of energy consumption.

What is claimed is:

1. A drying gun, comprising:

a body containing a chamber and an integral handle, an exhaust hole being defined inside the chamber, a front hole being disposed in front of the exhaust hole and a rear hole being disposed behind the exhaust hole, an internal thread being disposed to the terminal of the rear hole, an arc diverter being disposed between an inner end of the rear hole and the exhaust hole, an air inlet connecting through the rear hole being disposed in the handle, and an air valve being screwed to the bottom of the air inlet of the handle;

a plug accommodated in the rear hole of the chamber comprising an annual groove to receive insertion of an O-ring, a front tapered hole and a rear tapered hole corresponding to and connecting through each other being provided in the plug, the front tapered hole being outwardly flared and corresponding to the arc diverter;

a rear cover having a threaded portion to be screwed into the body and an air inlet tapered hole, and an accommodation hole being provided in a rear end of the rear cover;

a strainer being inserted into the accommodation hole of the rear cover;

a cock being inserted into the accommodation hole of the rear cover to locate the strainer and provided with an inner tapered hole; and a diffuser packed to the front of the body containing a flared hole.

2. The drying gun as claimed in claim 1, wherein a narrow exhaust gap is defined between a front surface of the plug and the inner end of the rear hole when the plug is received in the rear hole of the chamber and secured by the rear cover.

3. The drying gun as claimed in claim 1, wherein the starting point of the arc diverter is at a level higher than that of a camber of the front tapered hole.

4. The drying gun as claimed in claim 1, wherein an annular groove is disposed onto a collar at one end of the diffuser to receive insertion of an O-ring.

5. The drying gun as claimed in claim 1, the strainer is disposed behind the rear cover.

6. The drying gun as claimed in claim 1, the direction of the flared hole of the diffuser and that of the exhaust hole of the body defines a certain angle.

* * * * *